US005102006A

United States Patent [19]

Schellenberg

[11] Patent Number: 5,102,006

[45] Date of Patent: Apr. 7, 1992

[54] CONTAINER FOR GASTIGHT PACKING

[75] Inventor: Walter Schellenberg, Diepoldsau, Switzerland

[73] Assignee: Sandherr Packungen AG, Diepoldsau, Switzerland

[21] Appl. No.: 605,970

[22] Filed: Oct. 29, 1990

Related U.S. Application Data

[63] Continuation of Ser. No. 67,294, Jun. 26, 1987, abandoned.

[30] Foreign Application Priority Data

Jun. 30, 1986 [CH] Switzerland ..... 02625/86

[51] Int. Cl.[5] ..... B65D 5/64

[52] U.S. Cl. ..... 220/450; 220/408; 229/3.5 MF; 229/1.5 B

[58] Field of Search ..... 220/404, 408, 450, 453, 220/462; 229/3.1, 3.5 MF, 1.5 B, 903, 905

[56] References Cited

U.S. PATENT DOCUMENTS

| | | | |
|---|---|---|---|
| 1,624,010 | 4/1927 | Rollman | 220/408 X |
| 1,840,616 | 1/1932 | Burke | 220/450 X |
| 2,658,662 | 11/1953 | Paulsen | 229/3.5 MF |
| 2,842,301 | 7/1958 | Albert | 229/3.5 MF X |
| 2,853,222 | 9/1958 | Gallagher | 220/450 X |
| 2,970,736 | 2/1961 | Baughan | 229/3.5 MF |
| 3,023,922 | 3/1962 | Arrington et al. | 220/408 |
| 3,065,895 | 11/1962 | Lipschutz et al. | 220/408 X |
| 3,298,559 | 1/1967 | Lurie | 220/450 |
| 3,515,331 | 6/1970 | Guthrie, Sr. | 220/450 X |
| 3,938,730 | 2/1976 | Detzel et al. | 220/408 X |

FOREIGN PATENT DOCUMENTS 596719 4/1960 Canada .

*Primary Examiner*—Steven M. Pollard
*Attorney, Agent, or Firm*—Ladas & Parry

[57] ABSTRACT

Container (1) comprises a relatively rigid outer container (2) and an inner container (3) forming an inner lining. Inner container (3) is manufactured from blanks of thin, plastic-coated aluminum foil and has welded overlap seams running along a fold. The outer container protects the inner container (3) ensuring the necessary tightness against damage leading to leaks. Except for an aluminum coating of less than 0.02 mm thick, which ensures the tightness and light protection, the container is made from plastic, or in the case of outer container (2) from some other combustible material. Its temperature loading and tightness characteristics make container (1) suitable for packing foods to be sterilized, as well as for carbon dioxide-containing drinks. The container is conical for space-saving transportation purposes.

14 Claims, 1 Drawing Sheet

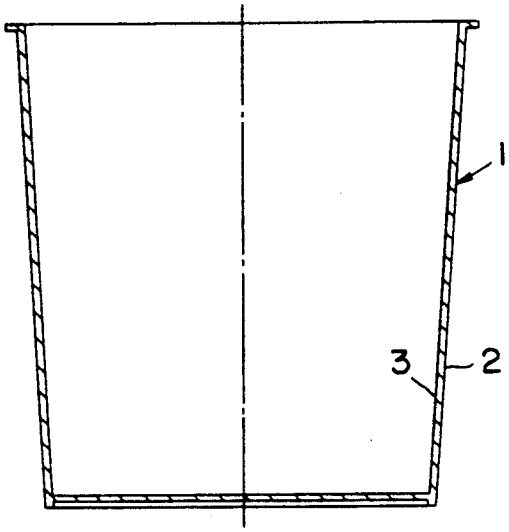
FIG. 1
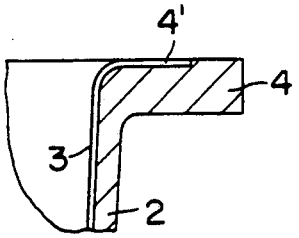
FIG. 2
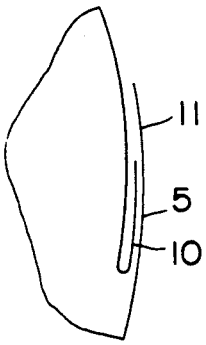
FIG. 3
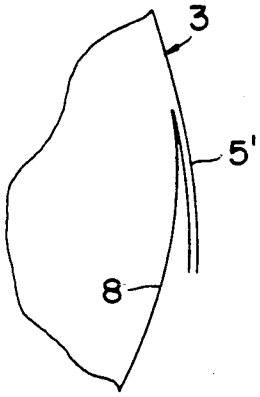
FIG. 4
FIG. 5
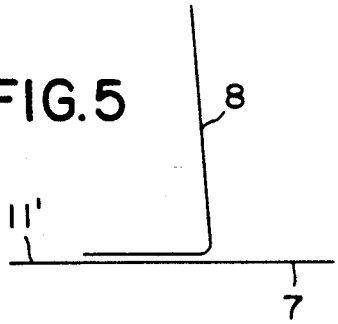
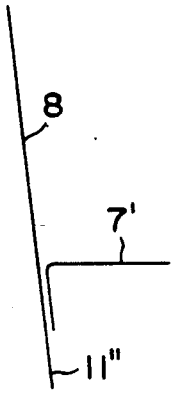
FIG. 6
FIG. 7
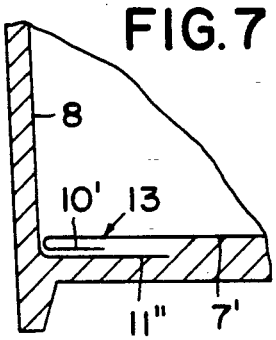

CONTAINER FOR GASTIGHT PACKING

This is a continuation of co-pending application Ser. No. 07/067,294 filed June 26, 1987, now abandoned.

BACKGROUND OF THE INVENTION

The invention relates to a container for gastight packing according to the preamble of claim 1.

Hitherto the gastight packing of e.g. carbon dioxide-containing beverages has either taken place in glass containers or in deep-drawn, cylindrical sheet metal containers. These containers have the advantage that they maybe exposed to temperatures of 130° to 140° C. necessary for sterilizing the container content. However, the transportation thereof from manufacturer to filler requires a relatively large transportation volume, because they are not stackable. Tests carried out with plastic containers, e.g. of polyester, which can also be exposed to elevated temperatures without deformation have shown that the gastightness thereof is not adequate to maintain an elevated internal gas pressure for a long period, such as is required for filling with e.g. carbon dioxide-containing beverages. In addition, known used gastight containers overburden refuse disposal systems.

The problem of the present invention is to find a container of the aforementioned type, which is substantially formed from material which can be burnt without leaving any residue and which, whilst having adequate mechanical strength, particularly against permanent deformation, e.g. due to transportation stresses, has an adequate gastightness and also permits a thermal sterilization of its content. In addition, the container must be stackable prior to filling.

SUMMARY OF THE INVENTION

According to the invention this problem is solved in that the container comprises a relatively thin-wall, gastight inner lining having overlapping seams and a relatively thicker-walled outer container body firmly connected thereto. Preferably, the container is conical in a per se known manner and, at least on its open side, the inner lining and outer container have flanges engaging on one another.

Preferably the inner lining is formed from a plastic-coated aluminium foil, the outer plastic layer of which being weldable to the material of the outer container body if the latter is also made from plastic, or is connected thereto by adhesion if made from another material, such as e.g. cardboard. Including the plastic covering, the thickness of the foil is less than 0.15 mm and the actual aluminium layer is preferably less than 0.02 mm.

The inner lining made from a foil blank ensures the tightness reaching the container, as well as the protection against light of the container contents. The plastic coating of the aluminium foil contributes to the tightness and also protects the aluminium layer against corrosion. The overlap seams of the inner lining are preferably designed in per se known manner, so that in each case similar coatings of the foil are welded together. This is brought about in that the inner layer is folded outwards beforehand and before the overlapping edge is placed above it for welding purposes. Thus, there is a triple layer thickness along the overlap seams. In the case of internal pressure loading of the container, the layers are pressed against one another at the seam, which further improves the reliability of the seal at this point.

Due to the fact that the inner lining having the aluminium layer has a particularly thin wall, there is no possibility of permanent deformation under external local pressure application and elastic deformation of the outer container. The outer container provides container stability and protects the inner lining against damage which could be caused by a leak.

For the purpose of the decorative finish of the container, preferably the blanks for the inner lining and consequently the inner lining itself can contain printing, if the injection moulded or deep-drawn outer container body is made from transparent plastic, e.g. polypropylene. However, the actual outer container body can have the printing and can e.g. be made from cardboard, as is known per se from Swiss patent 647 453.

Following the filling of the container, the closure thereof can take place as a function of the intended use, e.g. as a drinking container, by a relatively rigid, gastight lid, which is connected to the container flange, e.g. by beading or welding. For example the container cover or lid, in much the same way as for tin cans, is made from sheet metal with a tear-open closure, or is constructed in multilayer form, similar to the construction of the main portion of the remaining container, with a thin foil portion ensuring tightness and a rigid cover portion connected thereto. A sheet metal container closure is e.g. known from U.S. Pat. No. 3,190,485.

BRIEF DESCRIPTION OF THE DRAWINGS

The invention is described in greater detail hereinafter relative to a non-limiting embodiment of an inventive container with two examples for the construction of an overlap seam and relative to the drawings, which show:

FIG. 1 A vertical axial section through the container without lid.

FIG. 2 A larger-scale partial cross-section in the vicinity of the opening rim of the container according to FIG. 1.

FIG. 3 A partial horizontal cross-section through the inner lining in the region of an overlap seam.

FIG. 4 A representation corresponding to FIG. 3 with a differently constructed overlap seam.

FIGS. 5 and 6 Simple overlaps in the connection region between the casing and the bottom of the inner lining, before the latter is pressed against the casing or bottom, for producing the overlap joint.

FIG. 7 A partial cross-section through a container in the vicinity of the transition between casing and bottom with a diagrammatic representation of the overlap joint produced as a result of the simple overlap according to FIG. 6.

DETAILED DESCRIPTION OF THE INVENTION

The represented container body 1 has a relatively rigid outer container 2, which determines the dimensional stability of the container and which protects against damage to the very thin-walled and correspondingly flexible inner lining 3 internally engaging thereon. Outer container body 2 can be separately produced by injection moulding from plastic, e.g. polypropylene, deep-drawing or winding from cardboard material, so that the inner lining separately produced from foil blanks, is subsequently inserted therein and connected thereto by bonding or welding at least along the marginal flanges 4, 4'. However, preferably, the prefabricated inner lining 3 is placed in an injection mold and the outer container body 2 is directly shaped onto inner lining 3 by injection moulding, so that it is welded to the thin plastic layer thereof.

The wall thickness of container body 2, which is e.g. 0.5 mm or more, is substantially determined by the strength requirements made on container 1. When choosing the material thereof, the gas permeability is unimportant, so that preference can be given to other aspects, such as not prejudicing the environment and/or being inexpensive. However, the inner lining is made from a thin foil with a thickness of preferably less than 0.02 mm and whose material choice is mainly determined by the requirement of very high gastightness. It is correspondingly necessary to choose a relatively high-quality material, such as e.g. plastic-coated aluminium foil, but whereof only a very small quantity is required. The minimum thickness is substantially determined by the processability of the inner 3, and so it is made from blanks for its casing part 8 and its bottom part 7, such that joining seams are formed for producing the solid three-dimensional structure by gas-tight overlap seams 5, 5', 13. Externally the foil of the inner lining 3 is thinly coated with a material, which can be easily welded to the material of the outer container body, e.g. polyproylene. The other, inner side of the foil is coated with a conventional thermal varnish or lacquer, in order to make it possible to easily produce the seam joints 5, 5', 13 by hot sealing.

FIGS. 3 and 4 show two examples for an overlapping connection along the casing seam 5, 5' running in the direction of an axis of the container, in such a way that along seam 5, 5' in each case inner layers of the foil are positioned facing one another and are welded to one another. In the example according to FIG. 3, there is also a foil rim 11, which continues circumferentially over the folded foil part 10, so that along the foil rim there is an additional contact with the welded or adhered joint, or even the simple bearing support between the inner coating and the outer coating of the foil.

For two different arrangements of an overlapping joining seam 13, FIGS. 5 and 6 show the initial simple overlap before, in the case of FIG. 5, it is folded back against the casing part 8 of inner lining 3 and, in the example according to FIG. 6, against the bottom part 7 of inner lining 3, so that it can be welded in this end position. As in the embodiment according to FIG. 3 of a circumferential seam, in the embodiments of FIGS. 5 and 6 there is also a foil rim 11', 11'' and which, in the end position, is continued over the folded foil part 10'.

Through a relatively wide overlap region 10, 10', as well as the folding of the engaging foil parts against the wall of inner lining 3, i.e. against the casing part 8 or bottom part 7, a reliable seal is obtained along seams 5, 5', 13, which is further closed by the fact that the internal pressure of the filled container 1 compresses the overlap seams.

Although the aluminium proportion used when employing an aluminium foil for inner lining 3 is negligibly small, the thermal conductivity of the aluminium coating has a surprisingly advantageous effect on the thermal shrinkage following the removal of the finished container 1 from an injection mold. Shrinkage is in fact approximately 50% less than when no aluminium foil is used.

There is no need to show the container lid or cover, because it can be produced in per se known manner, e.g. according to U.S. Pat. No. 3,190,485.

What is claimed is:

1. A gastight container comprising:

a relatively thick rigid outer container body including an open top, a closed bottom, and a casing extending between said top and said bottom;

a relatively thin inner lining made of a gastight foil material firmly adhered to substantially the entire inner surface of said outer body, thereby defining an open top, a closed bottom, and a casing for said inner lining, said inner lining casing extending between said open top and said bottom of said inner lining;

a first seam formed by joined edges of said inner lining casing and extending from said top to said bottom of said inner lining, said first seam including at least one fold of said inner lining to create a triple layered strip of said foil material along said first seam; and a second seam formed by joined edges of said inner lining at the intersection of said inner lining casing and said inner lining bottom, said second seam including at least one fold of at least one of said inner lining casing and inner lining bottom, to create a second triple layered strip of said film material along said second seam; and wherein said seam are comprised solely of said inner lining material and are exclusive of said rigid outer container body.

2. A container according to claim 1, wherein said inner lining is made from a plastic-coated aluminium foil.

3. A container according to claim 2, wherein the aluminium layer of the foil of said inner lining is less than 0.2 mm thick.

4. A container according to claim 2, wherein said outer body is made form polypropylene.

5. A container according to claim 2, wherein each of said seams has one foil edge overlapping another, outwardly folded, foil edge, so that the inner surfaces of said foil edges engage one another along said seam.

6. A container according to claim 5, wherein the overlap on each said seam extends beyond the folded foil edge, so that the overlapped foil has its inner coating engaging the outer coating of the foil beyond the folded foil edge.

7. The container according to claim 2, wherein the foil material at each said seam is folded such that the foil on at least two layers of said triple layered strip folds against itself.

8. A container according to claim 2, wherein said outer body is made from a material weldable to the plastic coating of said inner lining.

9. A container according to claim 1, wherein said outer body is made from cardboard.

10. A container according to claim 1, wherein said inner lining is shaped from a foil whose thickness is less than 0.15 mm.

11. A container according to claim 1 wherein:

the outside surface of said inner lining contains printing; and said outer body is made from transparent plastic.

12. The container according to claim 1, wherein said inner seamed lining has an upper margin and wherein said outer body has an upper margin, said inner lining and outer body being joined to each other at said margins, said joinder of said margins forming a flange.

13. The container according to claim 1, wherein said inner lining and outer body are generally conical in shape.

14. The container according to claim 1, wherein said triple layered strip of film material at said second seam includes a bottom layer, a middle layer, and a top layer, said middle layer of said second seam being directed radially inwardly.

* * * * *